United States Patent [19]

Ball

[11] 4,323,208

[45] Apr. 6, 1982

[54] FOLDING FINS

[75] Inventor: James Ball, Bristol, England

[73] Assignee: British Aerospace, Weybridge, United Kingdom

[21] Appl. No.: 117,640

[22] Filed: Feb. 1, 1980

[51] Int. Cl.[3] ..... F42B 13/32; F42B 15/16

[52] U.S. Cl. ..... 244/3.28; 244/3.29

[58] Field of Search ..... 74/425; 244/3.24–3.29

[56] References Cited

U.S. PATENT DOCUMENTS

| | | | |
|---|---|---|---|
| 3,023,854 | 3/1962 | Lohr | 74/425 X |
| 3,063,375 | 11/1962 | Hawley et al. | 244/3.28 |
| 3,098,445 | 7/1963 | Jackson | 244/3.28 |

*Primary Examiner*—Harold J. Tudor

*Attorney, Agent, or Firm*—Cushman, Darby & Cushman

[57] ABSTRACT

A folding fin assembly (2) for a flight vehicle in which a fin (3) is carried for rotation about a chordwise axis (Z—Z) upon a turntable (9), the turntable (9) being itself turnable with reference to a fixed base (5) about a given axis (W—W) transverse to the chordwise axis (Z—Z). This is effected by meshing worm gears (14, 8) which transmit rotary movement to the turntable (9) as the fin (3) is rotated about the chordwise axis. The fin (3) lies flat against the surface of the flight vehicle with its chordwise axis (Z—Z) transverse to a fore-and-aft axis (X—X) of the flight vehicle and on erection is turned so that the chordwise axis (Z—Z) lies parallel to the fore-and-aft axis (X—X) of the flight vehicle.

4 Claims, 5 Drawing Figures

FOLDING FINS

This invention relates to folding fin assemblies for flight vehicles, such as for example, guided or unguided weapons which require fins for stabilisation and/or control purposes during flight. The fins need to protrude well into the airstream during flight, but during storage and transport their presence is naturally most disadvantageous. If the launch of the flight vehicle is from the confines of a tube, the overall diameter of the vehicle requires to be sufficiently small to fit into an existing tube or small enough to allow a specially designed tube to be of reasonable dimension in cross section.

Accordingly it is well known to provide a flight vehicle with folding fins, but the present invention has for an objective an improved folding fin assembly in which a fin can lie flat alongside a flight vehicle body when in the folded position so that if desired a relatively long span fin can be used, and can be readily moved to a flight position, that is to say, erected.

A further objective is the provision of an assembly which allows airflow and/or inertia forces to effect such erection movement to a flight position.

Yet a further objective is the provision of a self-contained assembly which can be rotated as a unit with reference to the vehicle body to effect flight control movements of the erected fin.

According to the present invention, a folding fin assembly for a flight vehicle includes a base member, a fin having a generally chordwise axis, a turntable member carried by the base member for turning relatively to the base member about a given axis, bearing means for mounting the fin on the turntable member for rotation about the chordwise axis, the chordwise axis lying generally transverse to said given axis, and transmission means for operatively connecting the fin, the turntable member, and the base member whereby rotation of the fin about its chordwise axis causes the turntable member to turn about its given axis.

Preferably the transmission means includes first worm means rotatably associated with the fin, and carried by the turntable member for turning therewith, and second worm means meshing with the first worm means and fixedly associated with the base member.

According to a further aspect of the invention, a flight vehicle, having a vehicle body with a fore-and-aft axis, includes at least one folding fin assembly, the or each assembly including a base member attached to the body, a fin having a generally chordwise axis and a generally spanwise axis, a turntable member carried by the base member for turning relatively to the base member about a given axis extending generally radially from the fore-and-aft axis, bearing means for mounting the fin on the turntable member for rotation about the chordwise axis, the chordwise axis lying generally transverse to said given axis, and transmission means for operatively connecting the fin, the turntable member, and the base member whereby rotation of the fin about its chordwise axis from a position in which its spanwise axis lies generally parallel and its chordwise axis lies generally transverse to the fore-and-aft axis to a position in which its spanwise axis lies on or generally parallel to said given axis causes the turntable member to turn with respect to the base member so that the chordwise axis lies generally parallel to the fore-and-aft axis.

One preferred embodiment of the invention is described with reference to the accompanying drawings in which.

In the Figures, a flight vehicle, in this case a guided weapon, has a body 1 with a fore-and-aft axis X—X. A folding fin assembly 2 including a fin 3 and a mechanism 4 for erection of the fin 3 from a folded, inoperative, position (shown in unbroken outline in the Figures) to an erected, operative position (shown in broken outline) is carried upon the body. In the Figures only one fin (and its associated mechanism) is shown for clarity, in practice four such fins (and their associated mechanisms) would be carried in a cruciform arrangement.

Figure 2:
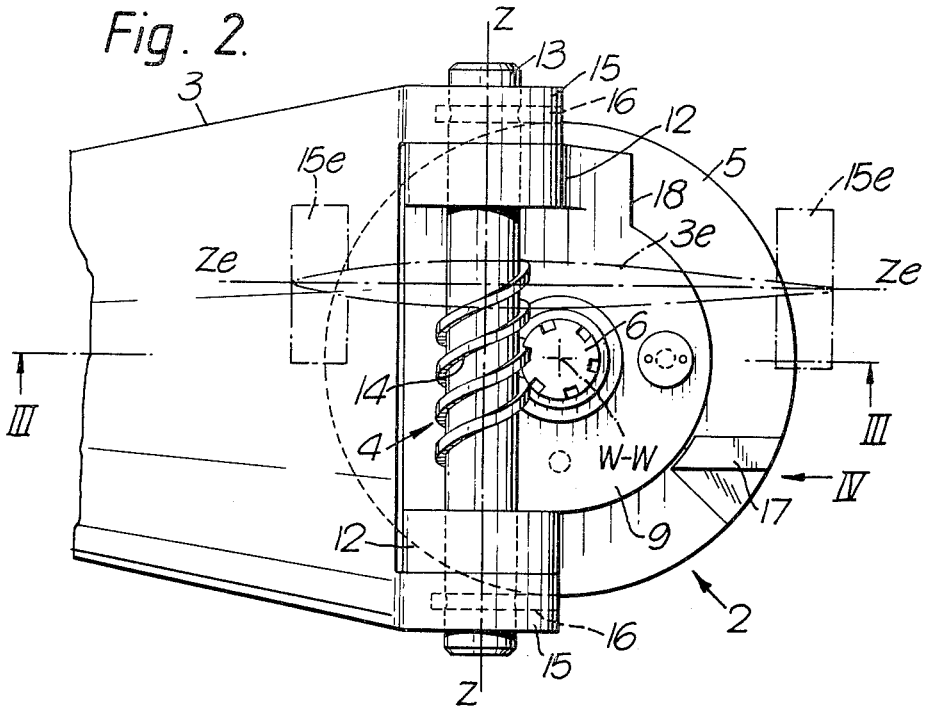
FIG. 2 is an enlarged plan view upon Arrow II of FIG. 1.
Figure 3:
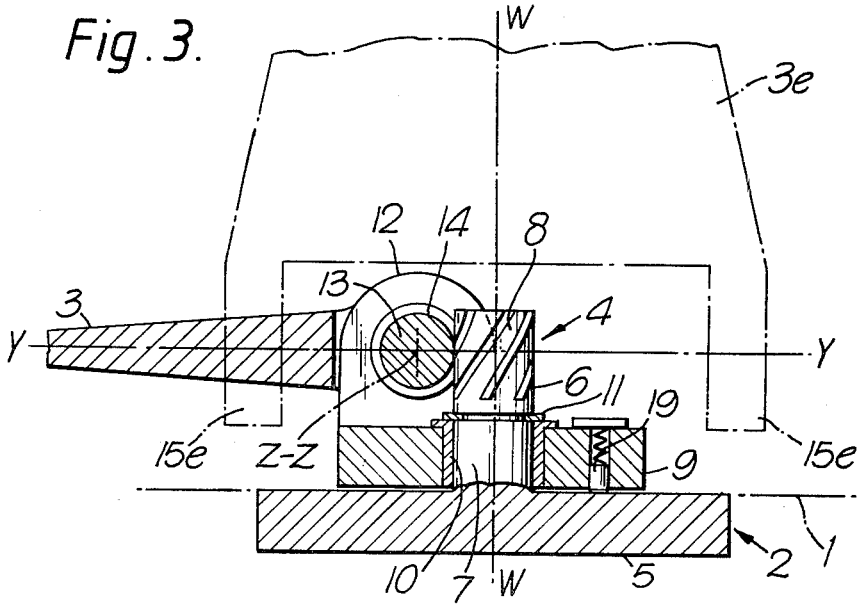
FIG. 3 is a cross sectional view upon Arrows III—III of FIG. 2.

The fin 3 has a spanwise axis Y—Y, and a chordwise axis Z—Z. When in the folded position, the spanwise axis Y—Y of the fin lies parallel with the axis X—X of the body whilst the chordwise axis Z—Z lies transverse to the axis X—X. When in the erected position, the spanwise axis Y—Y of the fin lies transverse to the axis X—X but slightly offset to one side, and the axis Z—Z lies parallel to the axis X—X, that is to say slightly offset when viewed in the plan view of FIG. 2.

For clarity the axes and the relevant reference numerals are shown with the suffix 'e' when relating to the fin erected position.

The assembly includes a base member 5 which is arranged for attachment to or to form part of the body 1. It is of circular form in plan so that it can rotate with reference to the body in an arrangement to be described. The base member 5 itself has a spigot 6 formed about an axis W—W which is normal to and intersects the axis X—X; it thus extends radially from the fore-and-aft centre line. The spigot 6 has a cylindrical bearing portion 7 and a worm portion 8. The worm portion 8 engages with a further worm portion to which reference is made below. Carried by the base member and located by the bearing portion 7 of the spigot is a turntable member 9. This has an aperture lined with a bearing sleeve 10, for accurate location on the bearing portion 7. A circlip 11 maintains the turntable member 9 close to the base member 5 at all times.

The turntable member 9 has two spaced lugs 12, one to each side of the axis W—W which form bearings for a shaft 13. The shaft 13 is rotatable about axis Z—Z, that is to say the chordwise axis, and carries a worm portion 14, to which reference has previously been made, permanently in meshing engagement with that referenced 8. Coveniently the helix angle of the worm portions 8 and 14 is about 45°.

The shaft 13 protrudes outboard of the lugs 12 to carry spaced lugs 15 formed upon a base region of the fin 3. Pins 16 ensure that the lugs 15 remain fast with the shaft.

A stop 17 is formed on the base member for engagement by a shoulder 18, formed upon the turntable member 9, when erection is complete. A spring loaded plunger 19 locks the turntable member 9 to the base member in this position.

In operation, assuming that the fin 3 is lying with its spanwise axis Y—Y parallel to the axis X—X and its chordwise axis Z—Z transverse to the axis X—X, erection of the fin by rotational movement about the axis Z—Z causes the shaft 13 to rotate the two intermeshing worm portions 14 and 8 transmitting this rotational movement to the turntable member 9 by virtue of the fact that the worm portion 8 is fixed with reference to the base member 5. The turntable member 9 turns about the axis W—W until the axis Z—Z reaches a position of parallelism with the axis X—X as shown at Ze—Ze. At this stage the fin 3 is fully erected with its spanwise axis parallel with the axis W—W which itself is normal to the axis X—X.

Figure 1:
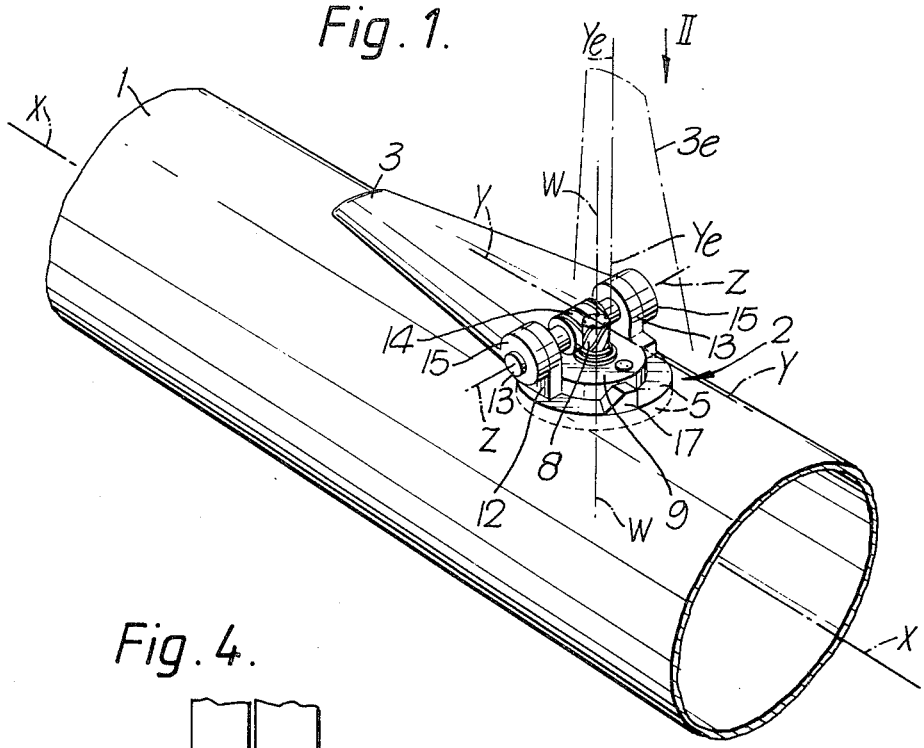
FIG. 1 is a pictorial view of part of a flight vehicle.
Figure 4:
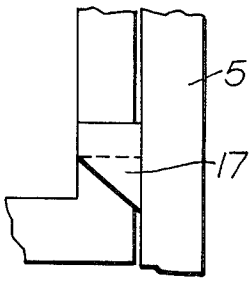
FIG. 4 is a detail view upon Arrow IV of FIG. 2.
Figure 5:
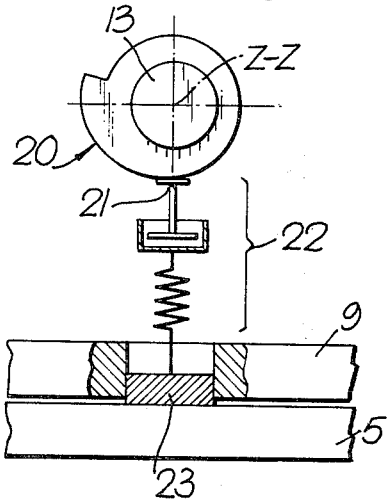
FIG. 5 is a diagrammatic view of a mechanism to be described.

The lifting of the fin 3 away from the body, that is to say the rotation about the axis Z—Z, is effected by the airflow during flight and/or by inertia. Alternatively, the fin 3 can be raised by power actuation means, not shown, but arranged to rotate the shaft 13.

Where airflow or inertia is used, some form of retardation is necessary as the shoulder 18 approaches the stop 17. As illustrated diagrammatically in FIG. 5 a braking mechanism for this purpose comprises a cam 20 attached to the shaft 13, a follower 21 constrained to urge a velocity sensitive dashpot and coil spring assembly 22 against a brake pad 23, the brake pad 23 being carried by the turntable member 9, so that the brake pad 23 itself is progressively urged against the base member 5 as the shaft 13 rotates.

Since the fin assembly 2 can be formed as a self-contained unit, the base member can be mounted for rotational movement upon the body 1. The angular setting of the fin relative to the body can thus be varied to effect flight control of the vehicle.

I claim:

1. A flight vehicle having a generally elongate body with a fore and aft axis and at least one folding fin assembly, said assembly including a base member attached to said body, a fin having a generally chordwise axis which extends from the leading edge towards the trailing edge of the fin when in use and a generally spanwise axis which extends generally perpendicular to said chordwise axis and from said tip towards said base of said fin, a turntable member for turning relative to said base member, spigot means extending from said base member through said turntable member, turntable bearing means carried by said spigot member by which said turntable is rotatably located, fin bearing means on said turntable member by which said fin is pivotably carried on said turntable member for pivotable movement about its chordwise axis, transmission means having a first part fixedly associated with said spigot means and a second part fixedly associated with said fin and coupled with said first part whereby pivotal movement of said fin about its chordwise axis from a position in which its spanwise axis lies generally parallel to said fore-and-aft axis and with said fin lying generally flat alongside said body of said flight vehicle with its chordwise axis lying generally transverse thereto, to a position in which said spanwise axis of said fin lies generally perpendicular to the fore-and-aft axis causes the second part of said transmission means to rotate bodily around said first part whereby the turntable member is turned with respect to said base member and the chordwise axis of said fin lies generally parallel to said fore-and-aft axis.

2. A flight vehicle as claimed in claim 1 wherein a shaft member is provided which is fixedly attached to said fin parallel with its chordwise axis and is carried by said fin bearing means, said second part being fixedly carried by said shaft member.

3. The flight vehicle as claimed in claim 1 including braking means for retarding turning movement of said turntable member.

4. The flight vehicle as claimed in claim 1 wherein said first and second parts are each gear means intermeshing with each other.

* * * * *